US005777570A

United States Patent [19]

Kokubu

[11] Patent Number: 5,777,570

[45] Date of Patent: Jul. 7, 1998

[54] TRANSMIT-RECEIVE SYSTEM

[75] Inventor: Sadao Kokubu, Niwa, Japan

[73] Assignee: Kabushiki Kaisha Tokai-Rika-Denki-Seisakusho, Aichi-ken, Japan

[21] Appl. No.: 623,005

[22] Filed: Mar. 28, 1996

[30] Foreign Application Priority Data

Mar. 31, 1995 [JP] Japan ..... 7-076430

[51] Int. Cl.[6] ..... G08C 17/00

[52] U.S. Cl. ..... 341/173; 340/825.69; 340/825.31; 340/825.72

[58] Field of Search ..... 341/173, 174; 340/870.31, 870.37, 870.3, 870.07, 870.16, 825.04, 825.06, 825.2, 825.21, 825.3, 825.44, 825.54, 825.69; 380/21, 23

[56] References Cited

U.S. PATENT DOCUMENTS 5,134,392 7/1992 Takeuchi ..... 340/825.69
5,442,341 8/1995 Cambropoulos ..... 340/825.31
5,506,905 4/1996 Markowski ..... 380/23
5,508,692 4/1996 Wolfram ..... 340/825.31
5,541,571 7/1996 Ochs ..... 340/825.31

*Primary Examiner*—Jeffery Hofsass
*Assistant Examiner*—Albert K. Wong
*Attorney, Agent, or Firm*—Oliff & Berridge

[57] ABSTRACT

A transmit-receive system is composed of a portable transmitter-receiver and an external transmitter-receiver that exchange data by using air-propagating signals. The portable unit has a start switch, and transmits a start signal to the external unit when the start switch is turned on. Upon receiving the start signal, the external unit transmits a question signal to the portable unit. Upon receiving the question signal, the portable unit transmits thereto a response signal. Optionally, the external unit intermittently transmits the question signal, and becomes ready to receive during the question signal intermission. The external unit stops transmission of the question signal if it transmits the question signal a predetermined number of times without receiving the response signal. Further, the external unit intermittently becomes ready to receive for periods shorter than the question signal intermission.

5 Claims, 3 Drawing Sheets

START TRIGGER SIGNAL A
HIGH
LOW

CONTROL SIGNAL D'
HIGH
LOW
TRANSMISSION
TRANSMISSION INHIBITED

DATA D
HIGH
LOW
2
2

CONTROL SIGNAL E'
HIGH
LOW

DATA C
HIGH
LOW
2'

ID CODE TRANSMISSION
ON
OFF

DATA B
HIGH
LOW
1
1
1
3

TRANSMIT-RECEIVE SYSTEM

BACKGROUND OF THE INVENTION

1. Field of the Invention

The present invention relates to a transmit-receive system for data transmission and reception between a portable transmitter-receiver and an external transmitter-receiver by using air-propagating signals.

2. Description of the Related Art

An IC card system, that is, a known transmitter-receiver system, is applied to, for example, a vehicular electronic key system. In the vehicular electronic key system, an IC card (portable transmitter-receiver) provided in the form of an electronic key has an antenna coil, and a vehicle-installed card reader (external transmitter-receiver) has an antenna coil capable of electromagnetically coupling with the antenna coil of the IC card. The antenna coil of the card reader transmits a question signal in the form of an electromagnetic induction signal that propagates through air. When the antenna coil of the IC card receives the question signal, the IC card transmits from its antenna coil a vehicle-specific ID code signal. Then, the card reader reads the ID code transmitted from the IC card, and compares the ID code with an ID code pre-stored in a unit provided in the vehicle. If the two ID codes agree, the card reader operates to, for example, lock or unlock the doors and/or start the engine.

However, the electronic key system as described above has the following problems. The card reader needs to constantly transmit the question signal because it is not determined when communications with an IC card will start. Particularly, in a conventional system using electromagnetic induction signals as air-propagating signals, the card reader must transmit a high-power question signal because it is difficult to increase the reception sensitivity of the antenna coil provided in the IC card. In addition, if the area where the question signal from the card reader can be received is to be expanded for improved convenience, the card reader must use a further increased power to transmit the question signal.

SUMMARY OF THE INVENTION

The present invention is intended to solve the above-stated problems. It is an object of the invention to provide a transmit-receive system that eliminates the need for an external transmitter-receiver to constantly transmit a question signal so that the power consumption of the external transmitter-receiver can be reduced.

According to the present invention, there is provided a transmit-receive system for data transmission and reception by using air-propagating signals comprising: a portable transmitter-receiver having a start switch; and an external transmitter-receiver, wherein the portable transmitter-receiver has a start switch and transmits a start signal to the external transmitter-receiver when the start switch is turned on, and wherein upon receiving the start signal, the external transmitter-receiver transmits a question signal to the portable transmitter-receiver, and wherein upon receiving the question signal, the portable transmitter-receiver transmits a response signal to the external transmitter-receiver.

Preferably, the external transmitter-receiver intermittently transmits the question signal and becomes ready to receive during an intermission of the question signal, and the external transmitter-receiver stops transmission of the question signal if the external transmitter-receiver has transmitted the question signal a predetermined number of times without receiving the response signal.

It is also preferred that while waiting to receive the start signal, the external transmitter-receiver intermittently become ready to receive, and that a period during which the external transmitter-receiver is ready to receive while waiting to receive the start signal be shorter than the intermission of the question signal.

Furthermore, it is preferred to apply the transmit-receive described above to a vehicular electronic key system.

In the transmit-receive of the invention, the portable transmitter-receiver transmits a start signal to the external transmitter-receiver when the start switch of the portable transmitter-receiver is turned on. Upon receiving the start signal, the external transmitter-receiver transmits a question signal to the portable transmitter-receiver. Then, upon receiving the question signal, the portable transmitter-receiver transmits a response signal to the external transmitter-receiver. Thus, there is no need for the external transmitter-receiver to constantly transmit the question signal, and the power consumption of the external transmitter-receiver can be reduced.

Furthermore, in the preferred construction, since the external transmitter-receiver intermittently transmits the question signal and becomes ready to receive during the intermission of the question signal, and stops transmission of the question signal if the external transmitter-receiver has transmitted the question signal a predetermined number of times without receiving the response signal, the power consumption of the external transmitter-receiver can be further reduced.

In the other preferred construction, since while waiting to receive the start signal, the external transmitter-receiver intermittently becomes ready to receive, and since the period during which the external transmitter-receiver is ready to receive while waiting to receive the start signal is shorter than the intermission of the question signal, the power consumption can be still further reduced.

In addition, when applied to a vehicular electronic key system, the transmit-receive system of the invention will effectively reduce the power consumption of the vehicular battery.

BRIEF DESCRIPTION OF THE DRAWINGS

The foregoing and further objects, features and advantages of the present invention will become apparent from the following description of a preferred embodiment with reference to the accompanying drawings, wherein.

DETAILED DESCRIPTION OF PREFERRED EMBODIMENT

A preferred embodiment of the present invention applied to a vehicular key system will be described hereinafter with reference to the accompanying drawings.

Figure 1:
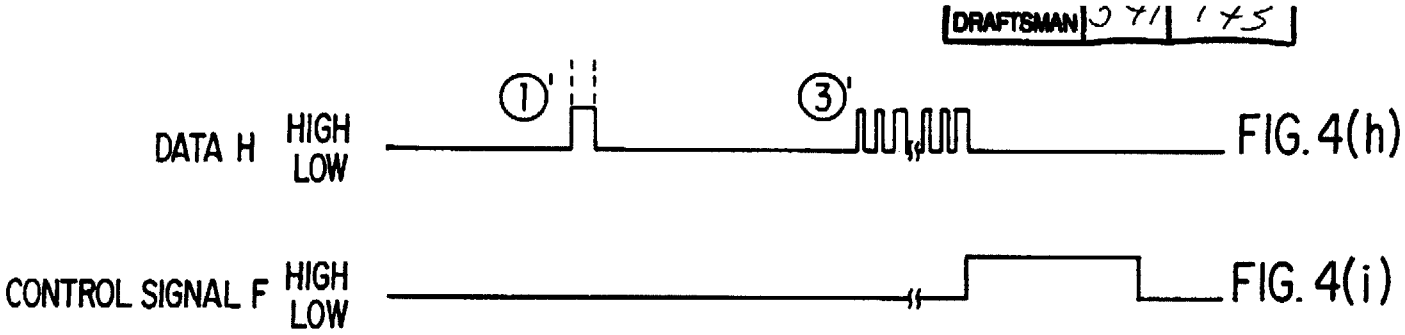
FIG. 1 is a block diagram of the electric construction of an embodiment of the present invention.
Figure 1:
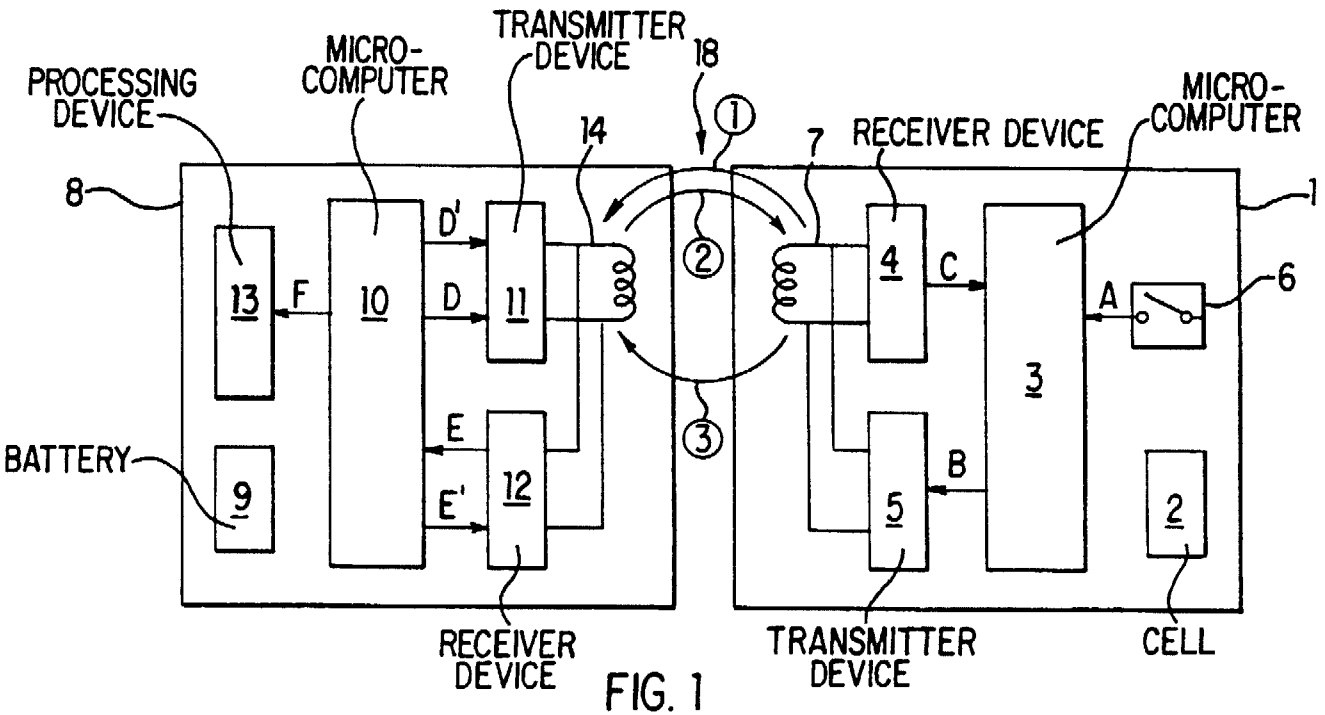

Referring to FIG. 1, an IC card 1 provided in the form of an electronic key contains a cell 2 that powers a microcomputer 3, a receiver device 4 and a transmitter device 5. A start switch 6 is made up of, for example, a push switch that performs momentary operation. An output terminal of the start switch 6 is connected to a start signal input terminal of the microcomputer 3. The start switch 6 is provided on a surface of the IC card 1, as shown in FIG. 2, so that when a user presses the start switch 6 to turn it on, the start switch 6 will continue to output a start trigger signal A at a high level while the user keeps pressing the start switch 6.

Although not shown in the drawings, the microcomputer 3 contains a ROM for storing control programs, a RAM for processing data, and an EEPROM for storing various data that include a vehicle ID code. A data output terminal of the microcomputer 3 is connected to a data input terminal of the transmitter device 5. A signal output terminal of the transmitter device 5 is connected to an antenna coil 7 so as to output data B received from the microcomputer 3 to the antenna coil 7.

Figure 2:
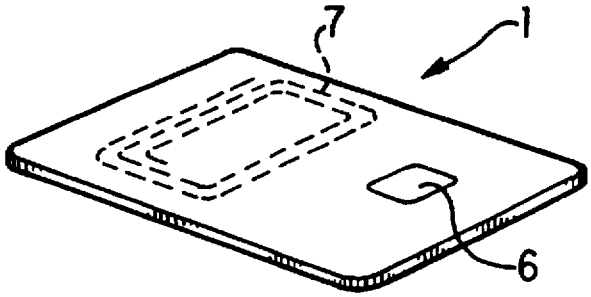
FIG. 2 is a perspective view of an IC card.

The antenna coil 7 is embedded in the IC card 1, forming a loop, as shown in FIG. 2. The antenna coil 7 is also connected to an input terminal of the receiver device 4 so that signals received thereby are supplied to the receiver device 4. A data output terminal of the receiver device 4 is connected to a data input terminal of the microcomputer 3 so that data C is supplied to the microcomputer 3. The IC card 1 is thus constructed.

On the other hand, a communication apparatus 8, that is, an external transmitter-receiver, is provided in a vehicle such as a motor vehicle. The communication apparatus 8 is powered by a battery 9 provided in the motor vehicle. More specifically, the battery 9 powers a microcomputer 10, a transmitter device 11, a receiver device 10 and a processing device 13.

As in the microcomputer 3, the microcomputer 10 contains a ROM for storing control programs, a RAM for processing data, and an EEPROM for storing various data that include a vehicle ID code. A data output terminal of the microcomputer 10 is connected to a data input terminal of the transmitter device 11 so that data D is outputted to the transmitter device 11. A control terminal of the microcomputer 10 is connected to a control terminal of the transmitter device 11 so that a control signal D' is outputted to the transmitter device 11. A signal output terminal of the transmitter device 11 is connected to an antenna coil 14 so that the data D received from the microcomputer 10 is outputted in the form of a modulated signal to the antenna coil 14.

Figure 3:
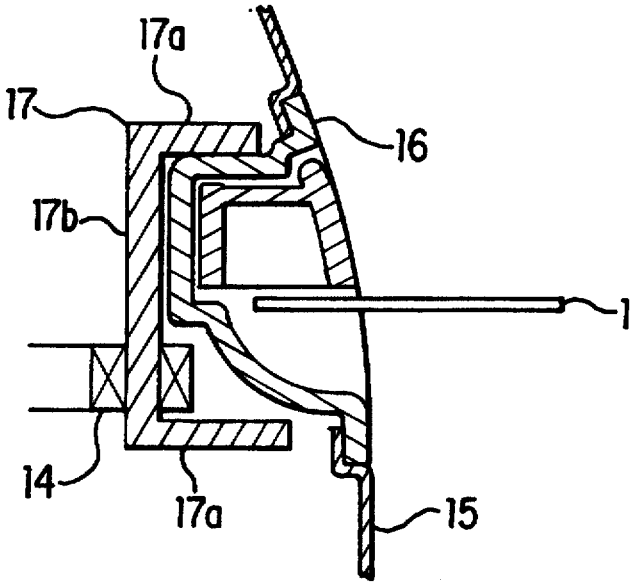
FIG. 3 is a sectional view illustrating an antenna coil part of the communication apparatus.

The antenna coil 14 has resonance frequencies equal to those of the antenna coil 7. The antenna coil 14 is provided around a U-shaped antenna part 17 composed of bar antennas 17*a* and a core 17*b* behind a door handle bracket 16 mounted on a door panel 17, as shown in FIG. 3. The antenna coil 14 is connected to a signal input terminal of the receiver device 12 to supply received signals to the receiver device 12. A data output terminal of the receiver device 12 is connected to a data input terminal of the microcomputer 10 so as to supply data E to the microcomputer 10.

A control terminal of the microcomputer 10 is connected to a control terminal of the receiver device 12 so as to supply a control signal E' to the receiver device 12. Another control terminal of the microcomputer 10 is connected to an input terminal of the processing device 13 serving as, for example, a door lock device, so that a control signal F is supplied to the processing device 13. The communication apparatus 8 is thus constructed. The IC card 1 and the communication apparatus 8 constitute a transmit-receive system 18.

The operation of the embodiment will now be described with reference to FIGS. 4(*a*)–4(*i*). In a normal waiting state that occurs before the communication apparatus 8 receives a start signal from the IC card 1, the communication apparatus 8 waits to receive a start signal while intermittently rendering the control signal E' to the high level so that the receiver device 12 becomes ready to receive for short time periods, as indicated by the timing chart of FIG. 4(*d*), in order to reduce the consumption of the power of the battery 9. In the normal waiting state, the microcomputer 3 of the IC card 1, on the other hand, stands by in a so-called sleep mode where, for example, the system clock frequency is reduced, in order to reduce the consumption of the power of the cell 2.

Figures 4A, 4B, 4C, 4D, 4E, 4F, 4G:
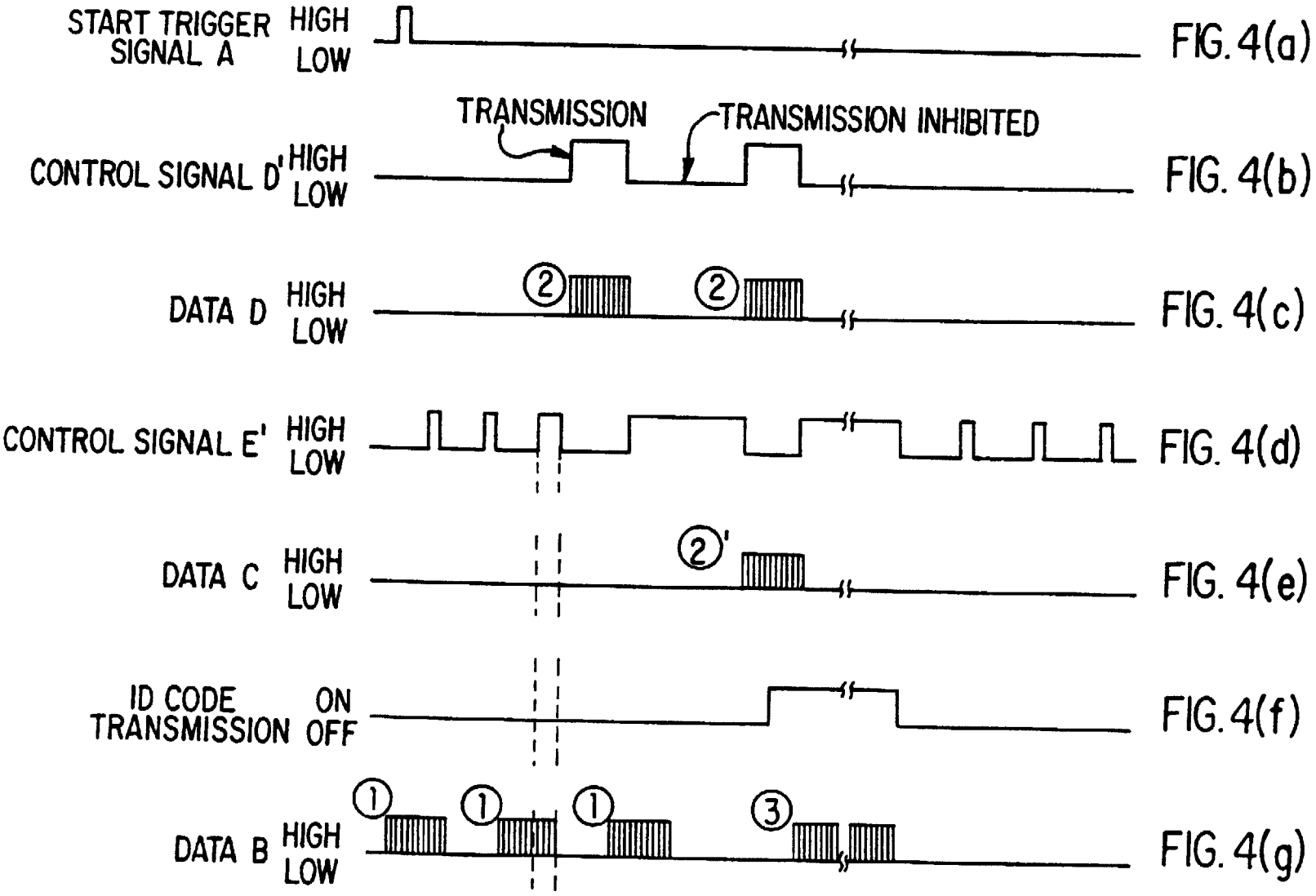
FIGS. 4(*a*) to 4(*i*) are timing charts.

When a user presses the start switch 6 so that the start trigger signal A momentarily shifts to the high level (see FIG. 4(*a*)), the sleep mode of the microcomputer 3 is canceled so that the microcomputer 3 becomes the normal operating state. Then, the microcomputer 3 outputs to the transmitter device 5 a start signal B modulated by predetermined data (nonsense data may be used for the modulation), as indicated by FIG. 4(*g*). The transmitter device 5 supplies the modulated start signal B to the antenna coil 7 to transmit therefrom a start signal ① in the form of an electromagnetic induction signal that propagates through air. If the start signal ① has been transmitted a predetermined number of times before the microcomputer 3 recognizes reception of a question signal, transmission of the start signal ① will be stopped.

If a user places the antenna coil 7 of the IC card 1 close to the antenna coil 14 of the communication apparatus 8 disposed behind the door panel 15 of the motor vehicle so that these antennas are electromagnetically coupled (see FIG. 3), the start signal ① from the antenna coil 7 is received by the antenna coil 14. The start signal ① is then received and demodulated by the receiver device 12 when the receiver device 12 becomes ready to receive. The demodulated signal is recognized as a start signal ①' (see FIG. 4(*h*)) by the microcomputer 10.

Then, the microcomputer 10 intermittently renders the control signal D' to the high level (see FIG. 4(*b*)) and supplies the signal to the transmitter device 11. The microcomputer 10 also supplies thereto a question signal ② as the data D that has been modulated by appropriate data (see FIG. 4(*c*)). The question signal ② is obtained by modulation using data, such as a code for specifying the type of IC card (for example, electronic keys or other type IC cards) or a communication permitting condition code. The transmitter device 11 energizes the antenna coil 14 to supply the question signal ② thereto, as in the IC card 1. If the question signal ② has been transmitted a predetermined number of times before the microcomputer 10 recognizes reception of a response signal, transmission of the question signal ② will be stopped.

While the microcomputer 10 intermittently transmits the question signal ②, the microcomputer 10 supplies the control signal E' to the receiver device 12 during an intermission of the question signal ② (that is, a period during which transmission is inhibited, as indicated in FIG. 4(*b*)), thereby intermittently making the receiver device 12 ready to receive. As indicated in FIG. 4(*d*), the reception-ready periods thus provided are longer than the reception-ready periods that occur when the receiver device 12 is in the waiting state described above.

When the antenna coil 7 of the IC card 1 receives the question signal ②, the received question signal ② is supplied as a question signal ②', that is, the data C, to the microcomputer 3 through the receiver device 4 (see FIG. 4(*e*)). After recognizing reception of the question signal ②', the microcomputer 3 collates the content of the question signal ②' in a predetermined manner. If the microcomputer 3 determines that communication is possible, the microcomputer 3 then reads the ID code from the built-in EEPROM, and converts the ID code into serial data and modulates it to form a response signal ③ as the data B, and supplies the response signal ③ to the transmitter device 5 (see FIG. 4(*g*)). The transmitter device 5 outputs the response signal ③ to the antenna 7, which transmits the signal in the form of an electromagnetic induction signal, as described above. The response signal ③ is then received by the receiver device 12 through the antenna coil 14 that is electromagnetically coupled with the antenna coil 7. The receiver device 12 demodulates the response signal ③ and outputs the demodulated response signal ③ as a response signal ③' to the microcomputer 10 of the communication apparatus 8 (see FIG. 4(*h*)).

Upon receiving the response signal ③, that is, the ID code, the microcomputer 10 reads the ID code pre-stored in the built-in EEPROM, and collates the received ID code with the stored ID code. If they agree, the microcomputer 10 renders the control signal F to the high level and supplies the signal to the processing device 13 (see FIG. 4(*i*)). When supplied with the control signal F, the processing device 13 performs control processing for, for example, the unlocking of the door locks. On the other hand, if the ID codes do not agree, the microcomputer 10 does not supply the control signal F to the processing device 13, and the processing device 13 does not perform the control processing.

According to the embodiment described above, when the start switch 6 of the IC card 1 provided as an electronic key is turned on, the microcomputer 3 of the IC card 1 transmits the start signal ① by using the transmitter device 5 and the antenna coil 7. The start signal ① is received by the antenna coil 14 of the communication apparatus 8 provided in the vehicle if the antenna coil 14 is electromagnetically coupled with the antenna 7. The received signal ① is supplied to the receiver device 12 and then to the microcomputer 10. Upon receiving the start signal ①, the microcomputer 10 transmits the question signal ② to the IC card 1 by using the transmitter device 11 and the antenna coil 14. Upon receiving the question signal ② through the antenna coil 7 and the receiver device 4, the microcomputer 3 transmits the response signal ③ to the communication apparatus 8. Thus, unlike the conventional apparatuses, the communication apparatus 8 does not need to constantly transmit the question signal ②. The consumption of the power of the battery 9 can thereby be reduced, which is highly advantageous for the vehicle using the battery as a DC power source.

Furthermore, the communication apparatus 8 intermittently transmits the question signal ②, and becomes ready to receive during the intermission of the question signal ②, and stops transmission of the question signal ② if the communication apparatus 8 has transmitted the question signal ② a predetermined number of times without receiving the response signal ③. Therefore, the embodiment further reduces the consumption of the power of the battery 9. In addition, the communication apparatus 8 intermittently becomes ready to receive while waiting to receive a start signal, in such a manner that reception-ready periods provided while the communication apparatus is waiting to receive the start signal is shorter than the intermission of the question signal ②. The consumption of the power of the battery 9 can thereby be still further reduced.

The present invention is not limited to the embodiment described above and illustrated in the drawings, but may be modified as follows.

The IC card 1 may transmit the start signal ① only while the start switch 6 is pressed.

Furthermore, the IC card 1 may repeatedly transmit the start signal ① until the IC card 1 detects reception of the question signal ② from the communication apparatus 8. Similarly, the communication apparatus 8 may repeatedly transmit the question signal ② until the communication apparatus 8 detects reception of the response signal ③ from the IC card 1.

The length of intermittent reception-ready period of the communication apparatus 8 preceding transmission of the question signal ② may be the same as the length of such period following the transmission of the question signal ②.

The receiver device 4 and the transmitter device 5 of the IC card 1 may be supplied with power through the microcomputer 3 when the start switch 6 is pressed.

The start switch 6 may be a slide switch.

The IC card 1 may be constructed so that the start switch 6 serves as a power switch, and so that when the start switch 6 is turned on, all the circuits in the IC card are powered, and so that the IC card 1 starts to transmit the start signal ① after the initialization.

The antenna coil 14 may be disposed in the form of a loop in a peripheral portion of a door-installed sideview mirror, and covered with the mirror casing.

The IC card 1 may carry information regarding the driver's license stored in the built-in storing means, in addition to serving as an electronic key.

The portable transmitter-receiver is not limited to the IC card 1, but may be provided in any form as long as it serves as a portable transmitter-receiver. For example, in the case of a vehicular electronic key system, the portable transmitter-receiver may be an ordinary electronic key.

The vehicle is not limited to a motor vehicle. The embodiment may be applied to various vehicles.

Furthermore, the present invention may be applied to not only a vehicular electronic key system but also other various systems that use, for example, bank cash cards, credit cards, season tickets, or entrance cards.

The external transmitter-receiver is not limited to an apparatus installed in a vehicle, such as the communication apparatus 8, but may be an apparatus that is installed, for example, indoors, and powered by a commercial AC power source. In such an application, the invention will also effectively reduce the power consumption.

The air-propagating signals are not limited to electromagnetic induction signals, but may be radio wave, light or electrostatic induction signals.

What is claimed is:

1. A transmit-receive system for data transmission and reception by using air-propagating signals comprising:

a portable transmitter-receiver having a start switch; and an external transmitter-receiver, wherein the portable transmitter-receiver transmits a start signal to the external transmitter-receiver when the start switch is turned on, and wherein upon receiving the start signal, the external transmitter-receiver transmits a question signal to the portable transmitter-receiver, and wherein upon receiving the question signal, the portable transmitter-receiver transmits a response signal to the external transmitter-receiver; and wherein while waiting to receive the start signal, the external transmitter-receiver intermittently becomes ready to receive, and wherein a period during which the external transmitter-receiver is ready to receive while waiting to receive the start signal is shorter than the intermission of the question signal.

2. A transmit-receive system according to claim 1, wherein the system is applied to a vehicular electronic key system.

3. A transmit-receive system according to claim 1, wherein the external transmitter-receiver intermittently transmits the question signal and becomes ready to receive during an intermission of the question signal, and wherein the external transmitter-receiver stops transmission of the question signal if the external transmitter-receiver has transmitted the question signal a predetermined number of times without receiving the response signal.

4. A transmit-receive system according to claim 3, wherein the system is applied to a vehicular electronic key system.

5. A transmit-receive system for data transmission and reception comprising:

an external transmitter-receiver;

a portable transmitter-receiver having a start switch, wherein the portable transmitter-receiver transmits a start signal to the external transmitter-receiver when the start switch is turned on; and means for transmitting, upon receiving the start signal, a signal from the external transmitter-receiver to the portable transmitter-receiver that repetitively alternates between a question signal period and a reception-ready period upon a single activation of said start switch.

* * * * *